US011276273B1

(12) United States Patent
Donahue, III et al.

(10) Patent No.: US 11,276,273 B1
(45) Date of Patent: Mar. 15, 2022

(54) LOTTERY SCRATCH TICKET APPLICATIONS

(71) Applicant: ScratchShark, Inc., Cohasset, MA (US)

(72) Inventors: Douglas A. Donahue, III, Cohasset, MA (US); Scott E. Blumberg, Venice, CA (US)

(73) Assignee: Scratchshark, Inc., Cohasset, MA (US)

( * ) Notice: Subject to any disclaimer, the term of this patent is extended or adjusted under 35 U.S.C. 154(b) by 0 days.

(21) Appl. No.: 16/888,745

(22) Filed: May 31, 2020

Related U.S. Application Data

(60) Provisional application No. 62/855,941, filed on Jun. 1, 2019.

(51) Int. Cl.
*G07F 17/32* (2006.01)

(52) U.S. Cl.
CPC ..... *G07F 17/323* (2013.01); *G07F 17/329* (2013.01)

(58) Field of Classification Search
None
See application file for complete search history.

(56) References Cited

U.S. PATENT DOCUMENTS

2013/0184071 A1* 7/2013 Gadher ..... G06F 12/00 463/29
2019/0114871 A1* 4/2019 Garrison ..... G07F 17/3248

* cited by examiner

*Primary Examiner* — Werner G Garner
(74) *Attorney, Agent, or Firm* — John Brooks Law LLC; John J. Brooks, III

(57) ABSTRACT

Processor-based systems and methods of recommending to a user which lottery ticket to play. Example embodiments of the methods include receiving a game structure, receiving an updated data, receiving a user risk/reward profile, determining a recommended lottery ticket for a user to play, and communicating the recommended lottery ticket to the user through a user interface. Example embodiments of lottery scratch ticket applications include a processor-based device executing an application that recommends which lottery ticket to play based on the game structure, updated data about the game and the user risk/reward profile of the user.

17 Claims, 5 Drawing Sheets

410

| Prizes | Odds 1 in | Total # of Winners | Odds - Lower Boundry | Odds - Upper Boundry | Tix - Lower Boundry | Tix Upper Boundry |
|---|---|---|---|---|---|---|
| $50,000 | 360,000 | 7 | 359,999.50001 | 360,000.49999 | 2,519,997 | 2,520,003 |
| $1,000 | 30,000 | 84 | 29,999.50001 | 30,000.49999 | 2,519,958 | 2,520,042 |
| $500 | 10,000 | 252 | 9,999.50001 | 10,000.49999 | 2,519,874 | 2,520,126 |
| $100 | 365.85 | 6,888 | 365.8450001 | 365.8549999 | 2,519,940 | 2,520,009 |
| $80 | 240 | 10,500 | 239.50001 | 240.49999 | 2,514,750 | 2,525,250 |
| $40 | 80 | 31,500 | 79.50001 | 80.49999 | 2,504,250 | 2,535,750 |
| $20 | 30 | 84,000 | 29.50001 | 30.49999 | 2,478,001 | 2,561,999 |
| $10 | 6.67 | 378,000 | 6.6650001 | 6.6749999 | 2,519,370 | 2,523,150 |
| Game Total | 4.93 | 511,231 | 4.9250001 | 4.9349999 | 2,517,813 | 2,522,925 |
| | | | | Highest Min | 2,519,997 | |
| | | | | Lowest Max | | 2,520,003 |
| | | | | Estimated Tix | | 2,520,000 |

FIG. 4

LOTTERY SCRATCH TICKET APPLICATIONS

CROSS-REFERENCE TO RELATED APPLICATIONS

This application claims the benefit of U.S. App. No. 62/855,941, filed on Jun. 1, 2019, entitled "Lottery Scratch Ticket Applications," the entire contents of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

This invention relates to systems and methods of selecting lottery tickets.

2. Background

Scratch tickets, also known as scratch-offs, scratch games, scratch-and-win, or instant win games attract millions of consumers in the U.S. and internationally each year. In the U.S., games embodied in scratch tickets are sponsored by the states' lottery programs, with proceeds from lottery games typically supporting public initiatives such as education.

Scratch tickets are typically offered in various dollar denominations ($1, $2, $3, $5, $10, and $20 or more), with multiple offerings concurrently available at each price point. Data available at the point of sale often includes the overall odds of winning a prize and various marketing claims that hint to the structure of the game (e.g., "Win up to $100,000" or "Five chances to win"), but do not provide meaningful insight into the detailed payout structure or odds of winning a given prize.

State sponsors of lottery games typically provide additional detail to consumers about game structure on their websites. Typically, a state will provide detailed information related to the structure of the game, including different prize levels and number of prizes available at each prize level at the start of the game. As the games progress, some states provide a degree of updated public information on prizes that have been claimed, but the amount and form of information provided varies from state to state. In many states, only prizes above a certain threshold are continuously reported and published (e.g., top three prizes, prizes over $100). Further, most states do not provide updated information on the current number of unsold tickets which is an important piece of information for evaluating current odds of winning.

With inconsistent and often incomplete data available from a wide number of sources, scratch ticket consumers do not have a means to quickly and easily compare ticket purchase options at the point of sale.

BRIEF SUMMARY OF THE INVENTION

The following summary is included only to introduce some concepts discussed in the Detailed Description below. This summary is not comprehensive and is not intended to delineate the scope of protectable subject matter, which is set forth by the claims presented at the end.

In brief overview, example embodiments of the systems and methods of the present inventive concepts provide actionable recommendations to its users through an application on a processor-based device such as a smartphone. In some embodiments, the application may be customized for each user telling the user which scratch ticket is the best ticket for the user to purchase. In some embodiments, recommendations are updated on a predetermined basis, for example, daily, to reflect actual ticket odds which change as prizes are claimed and tickets are sold at different rates.

In some embodiments, processor-based methods of recommending to a user which lottery ticket to play are provided comprising receiving a game structure, receiving updated data, receiving a user risk/reward profile, determining a recommended lottery ticket for a user to play, and communicating the recommended lottery ticket to a user interface.

In some embodiments, as shown in FIG. 1, lottery scratch ticket applications operate within a system 100 that includes a processor-based device executing an application that recommends which lottery ticket to play based on the game structure 110, updated data about the game 120 and the risk/reward profile of the user 130. The application may receive and/or utilize data from a database 140 and communicate recommendations to a user interface 150. The application may reside on a processor-based device such as a smartphone 150 or other remote computing device.

Other objects, features, and advantages of the techniques disclosed in this specification will become more apparent from the following detailed description of embodiments in conjunction with the accompanying drawings.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. The drawings are not necessarily to scale, emphasis instead being placed upon illustrating the principles of the embodiments. Understanding that these drawings depict only typical embodiments of the invention and are not therefore to be considered to be limiting of its scope, the invention will be described and explained with additional specificity and detail through the use of the accompanying drawings in which:

FIG. 4 shows a table illustrating an example embodiment of a method for estimating number of tickets at launch.

DETAILED DESCRIPTION OF THE INVENTION

Figure 1:
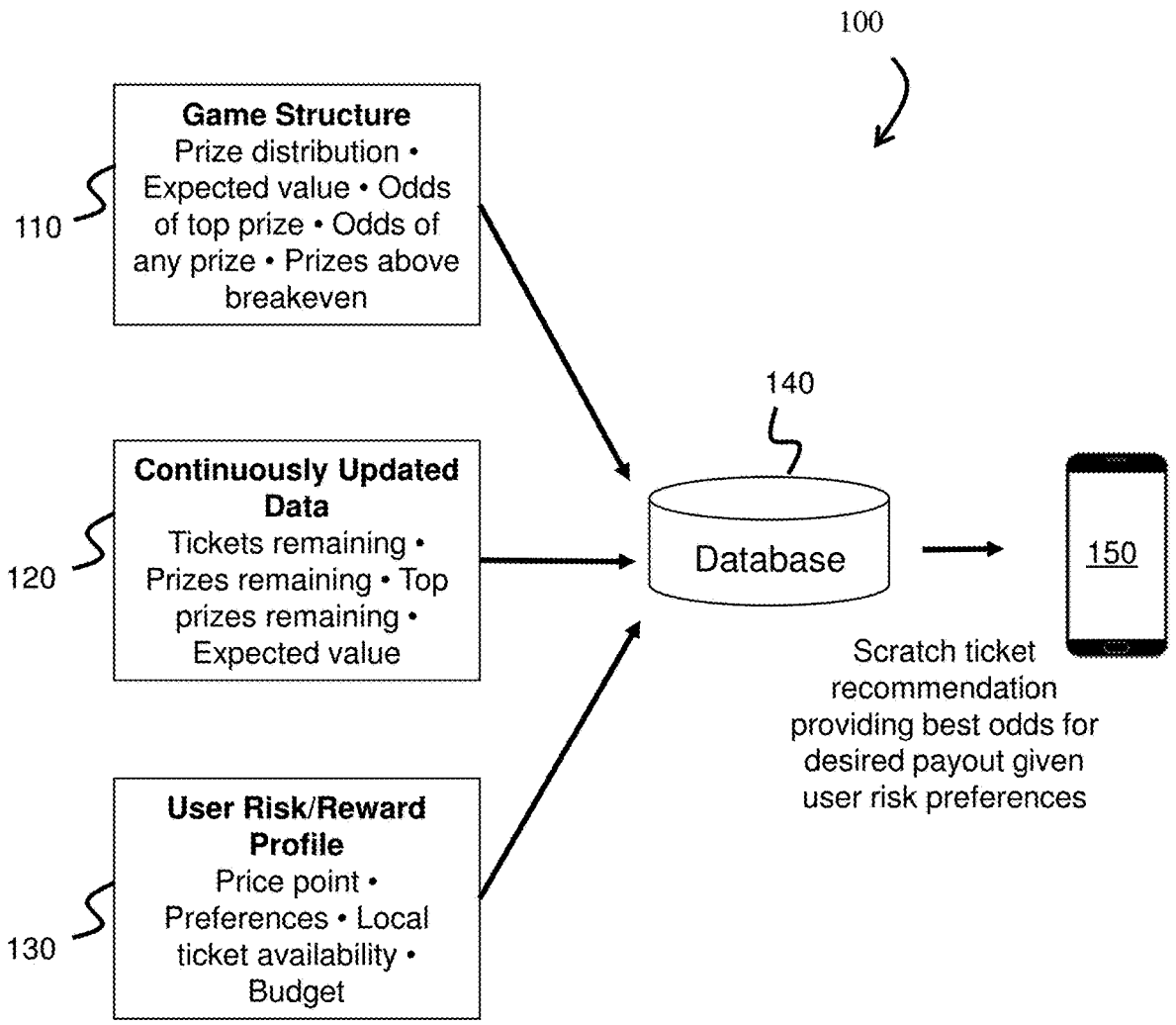
FIG. 1 shows a network diagram illustrating an environment in which embodiments of the present inventive concepts can be practiced.

COPYRIGHT NOTICE: A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The following notice applies to any software and data as described below and in the drawings hereto: Copyright © ScratchShark, Inc., 2019-2020, All Rights Reserved.

Lottery scratch ticket applications and methods of use will now be described in detail with reference to the accompanying drawings. It will be appreciated that, while the following description focuses on a system that recommends lottery tickets to play, the systems and methods disclosed herein have wide applicability. Notwithstanding the specific example embodiments set forth below, all such variations and modifications that would be envisioned by one of ordinary skill in the art are intended to fall within the scope of this disclosure.

The terminology used herein is for the purpose of describing particular embodiments and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on" or "connected" or "coupled" to another element, it can be directly on or above, or connected or coupled to, the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.). When an element is referred to herein as being "over" another element, it can be over or under the other element, and either directly coupled to the other element, or intervening elements may be present, or the elements may be spaced apart by a void or gap.

As used herein, the term "module" refers to hardware and/or software implementing entities, and does not include a human being. The operations performed by the "module" are operations performed by the respective hardware and/or software implementations, e.g. operations that transform data representative of real things from one state to another state, and these operations do not include mental operations performed by a human being.

In brief overview, referring to FIG. 1, the systems and methods of the present inventive concepts provide actionable recommendations to its users through a smartphone application customized for each user telling the user which scratch ticket is the best ticket for the user to purchase. The lottery scratch ticket application works within a system 100 that generally includes a processor-based device executing an application that recommends which lottery ticket to play based on the game structure 110, updated data about the game 120 and the risk/reward profile of the user 130. The application may receive and/or utilize data from a database 140 and communicate recommendations to a user interface 150. The application may reside and get executed on a computing device with the user interface 150 such as a smart phone or other computing device. Recommendations are updated on a predetermined basis, for example, daily, to reflect actual ticket odds which change perpetually as prizes are claimed and tickets are sold at different rates.

Figure 3:
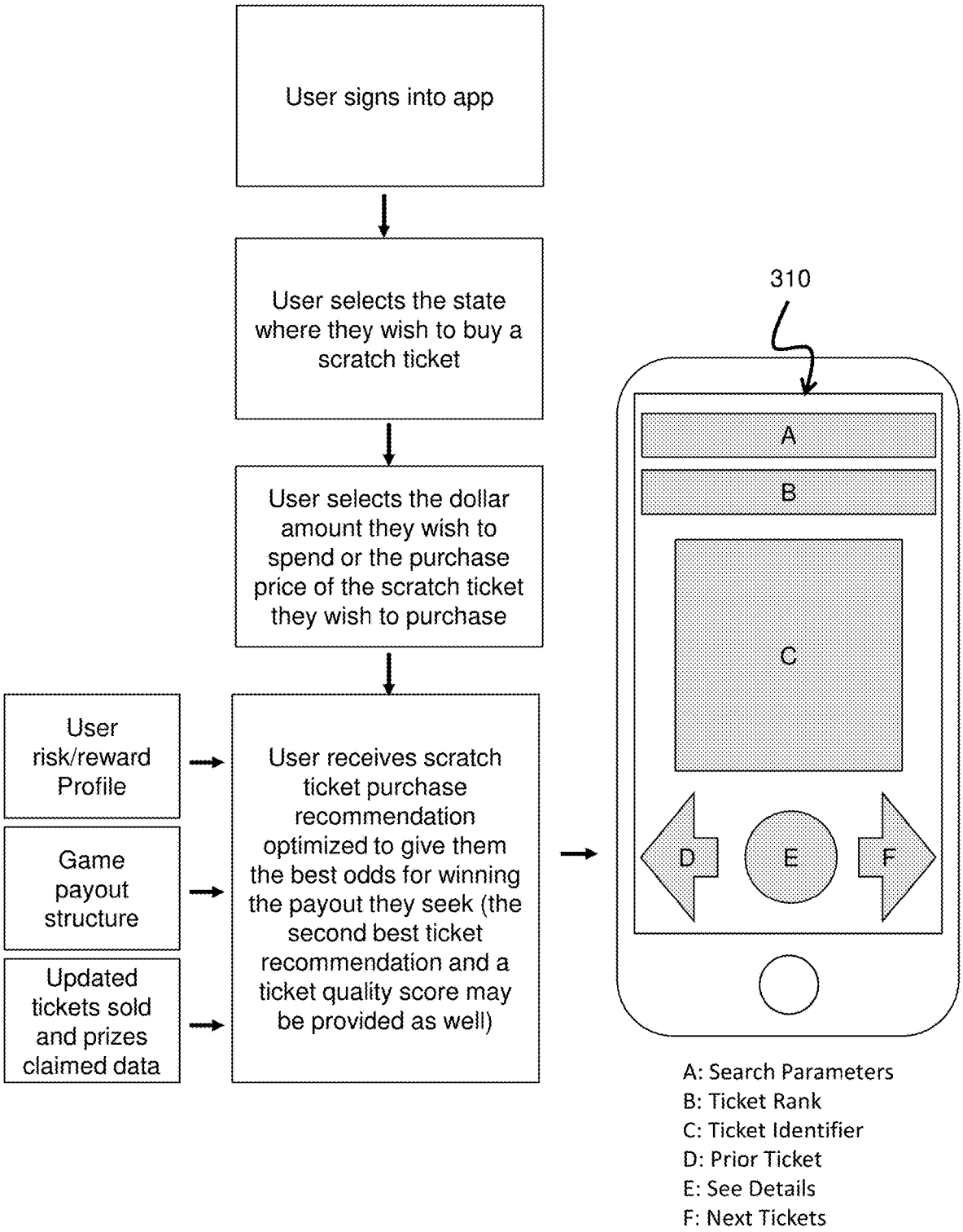
FIG. 3 shows a flow diagram of the operation of an example embodiment of a lottery scratch ticket application including presentation of data to a user interface of a user computer display, in accordance with some embodiments.

In some embodiments, referring to FIG. 1, the lottery scratch ticket application provides personalized recommendations for each user based on 1) which state the user intends to purchase a scratch ticket in 2) the user's purchase preference and budget (how much they intend to spend on ticket purchases), and/or 3) the user's risk/reward profile 130. In some embodiments, the system includes a database 140 comprising stated odds for scratch ticket games as well as the prizes that have been claimed and the tickets that have been sold (updated daily or as often as the state updates this information) permitting one or more algorithms to be executed by a special-purpose hardware computer that computes the current odds for winning each of the target prize levels offered to users. The systems and methods cross-reference user preferences against the database 140 containing current odds to recommend the ticket that gives the user the best odds of winning a prize that aligns with their risk/reward preferences, for example, which can be entered to a user interface 310 as shown in FIG. 3.

As part of identifying a user's risk/reward profile and to help the systems and methods identify the ticket that is the best fit for a user, each user may input that the user would like to buy a ticket that does one or more of:

- Gives them the highest expected value;
- Gives them the highest expected value (with break-even prizes removed);
- Gives them the best odds for winning any prize;
- Gives them the best odds for winning any prize (with break-even prizes removed); and
- Gives them the best odds for winning a prize equal or greater to a specified dollar amount (e.g., best odds for winning $1 million, or best odds for winning $1,000 etc.).

In addition to the foregoing, the invention includes a method for estimating the number of tickets remaining in a game when such data is otherwise not reported that is unique in that it extrapolates sales trends from multiple sources that may include remaining prize data, game start date, game end date, mentions in traditional media, mentions in social media, direct feedback solicited from users, and measurements of user interaction with the application.

In addition to the foregoing, the invention includes a method for characterizing the user's risk/reward profile that is unique in that it is adjusted over time based on direct user inputs, survey data, interaction with the application, demographic data, and the user's interests as indicated by publicly available social media presence.

In addition to the foregoing, the invention includes a method for expressing the quality of a scratch ticket in a single quantitative metric that is unique in that it utilizes both current stated and extrapolated ticket economic metrics, historical measures of economic metrics, and user risk/reward preferences to deliver the degree to which a ticket would appeal to the user.

As described herein, embodiments of the present invention may be a system, a method, and/or a computer program product including a computer readable storage medium having computer readable program instructions thereon for causing a computer hardware processor to carry out aspects of the present invention. For example, the computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Figure 2:
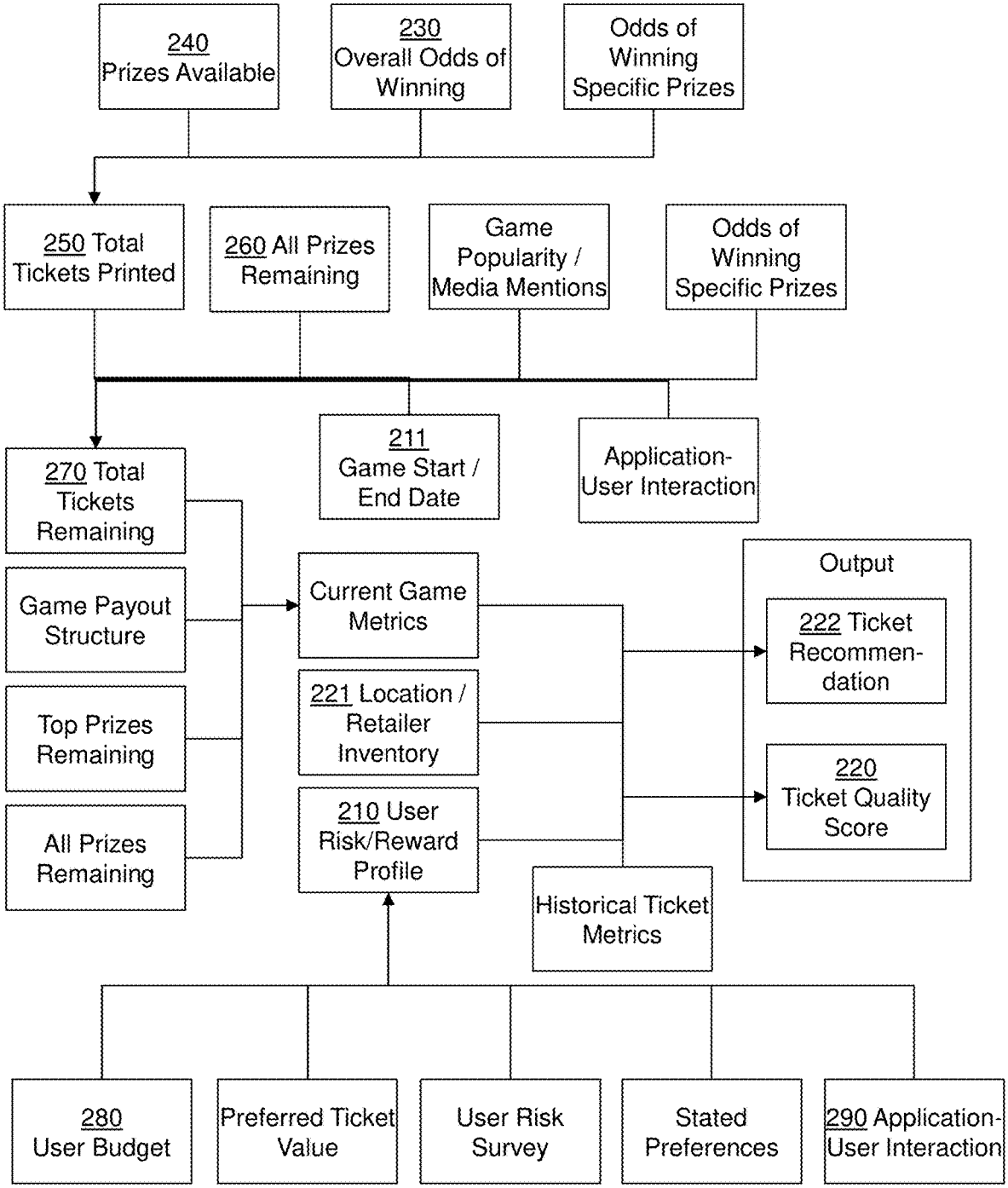
FIG. 2 shows a diagram of a method for calculating the user-specific ticket quality, in accordance with some embodiments.

FIG. 2 illustrates by way of example how an embodiment of the systems and methods evaluate ticket quality and match to user profile.

The following is an overview of FIG. 2, in particular, inputs and outputs to various electronic devices in communication with a data network, cloud computing environment, or the like.

Ticket Odds Inputs:

1) Overall odds of winning any prize 230: On the back of each ticket as well as most state lottery websites.
2) Initial prize structure and odds of winning each prize 240: Public information available on all state lottery websites.
3) Number of tickets printed/available for sale 250: May be provided on state lottery website; and extrapolate based on the number of prizes available and odds of winning each prize.
4) Number of prizes remaining at each level 260: Public information available on many state lottery websites; and acquired through direct partnerships with the state and delivered directly through an application programming interface (API).
5) Number of tickets remaining 270: Acquired through direct partnerships with the state and delivered directly through an application programming interface (API); and extrapolate based on the number of prizes available and odds of winning each prize.

User Preferences Inputs:

1) Which state the user intends to purchase a scratch ticket in: This information is either entered by the user or is provided by the mobile device's geolocation services to identify which state a user is in.
2) How much money the user wishes to spend on tickets and/or which ticket dollar denomination(s) the user prefers 280: This information is entered by the user.
3) User's risk/reward profile 210: This information is developed based on a combination of user inputs and measures of risk tolerance assessed by survey and behaviors.
4) User interaction with app 290: User interaction with application will help inform preferences and risk reward profile; and inputs may include but not be limited to: time of day, day of week, location, or ticket denomination.

Other Inputs:

1) Time on market of game 211: Launch date of the game may be available on state lottery website; and if not available explicitly, the date at which the game appears on the lottery website will be used.
2) Retailer inventory 221: Licensed from states based on distribution of printed tickets; and refined by user input insights (e.g., click button if this game is not available at your current location).

Software Application Output—Core Feature:

1) The application will provide the user with a recommendation 222 for the best scratch ticket(s) to purchase given the inputs.

Application Output—Other Features:

1) The application may also provide a ranked list of tickets by degree to which each ticket appeals to the user based on the inputs.
2) The application may also provide a score 220 with an individualized measure of the degree to which the ticket may appeal to the user based on risk/reward profile.
3) The application may also provide details of the game structure and odds for each ticket available to the user.
4) The application may also utilize the user's location via a smartphone GPS system or the like to match the user to tickets available to them, for example, by state and/or nearby retailers.
5) The application may log a user interaction with the application itself to refine a user profile and understanding of risk/reward preferences.
6) The application may generate and output a push notification or an alert on the application when it has identified a ticket that aligns with the user's preferences that has significantly increased odds vs. the baseline.
7) The application may also provide a score that measures the value of the ticket based on historical measures of value 220 (e.g., expected value vs. all tickets sold at that price point in the past year).
8) The application may also provide users with a recommendation for which ticket denominations to allocate their budget to (e.g., if a user wishes to spend $20, the systems and methods may recommend buying four $5 tickets instead of one $20 ticket).

FIG. 3 provides a graphical illustration showing one example embodiment of the general functional steps of operating an example lottery scratch ticket application.

One Example Embodiment of a Method of Extrapolating:

In order to establish continually updated odds of winning a prize, the systems and methods must approximate the number of tickets remaining at any given point. The invention has established methods for estimating number of tickets at launch and remaining at any point during the game.

An example of a method for estimating number of tickets at launch is shown at table 410 of FIG. 4:

Most states provide full transparency as to the number of prizes at each level and the odds of winning such prizes. However, odds are typically rounded to the nearest whole number, and thus may provide a slightly skewed view of total prizes remaining. In order to more accurately estimate the number of tickets available, we can estimate the lower and upper bounds of number of tickets projected at each prize point by using the largest and smallest number that would round to the stated odds. For example, if the stated odds are 7:1, then the smallest number that would round to 7:1 is 6.5 and the largest is 7.4999 . . . . Calculating odds at each price point using this method will allow us to identify the largest minimum number of tickets and the smallest maximum number of tickets suggested by the different prize points. Averaging the two provides a highly accurate estimate of number of tickets remaining. FIG. 4 shows a table that represents an example of estimating number of tickets at launch.

A method for estimating number of tickets remaining is represented by step 270 of FIG. 2:

To approximate percentage of tickets remaining, the system would incorporate multiple data points aimed at and electronically processed for estimating number of tickets sold over a period of time. One such metric may be a number of low value prizes remaining. For example, if 1 out of every 20 tickets wins a prize of $X and 2,000 prizes of $X have been claimed, the system multiplies the 2,000 prizes claimed by 20 to determine that roughly 40,000 tickets have been sold. This is based off the theory that random events (such as scratch ticket outcomes) with known odds will revert to their arithmetic mean when repeated several times, with the high frequency of low value prizes being won providing a low degree of variability. In addition, and when such data is not available, other inputs will be included to estimate ticket sales, including game start date and end date and measures of game popularity such as traditional media and social media mentions, as well as behaviors of users of the application. These data would be applied to historical sales trends for comparable game launches to estimate the proportion of tickets that will have been expected to be sold since game launch.

A number of implementations have been described. Nevertheless, it will be understood that the foregoing description is intended to illustrate, and not to limit, the scope of the inventive concepts which are defined by the scope of the claims. Other examples are within the scope of the following claims.

One Example Embodiment of a Lottery Scratch Ticket Application Implemented in a Software Program Product Executed by a Processor Based System:

As will be readily apparent to those skilled in the art, one embodiment of the lottery scratch ticket applications can be embodied in hardware, software, or a combination of hardware and software. For example, a computer system or server system, or other computer implemented apparatus combining hardware and software adapted for carrying out the methods described herein, may be suitable. One embodiment of a combination of hardware and software could be a computer system with a computer program that, when loaded and executed, carries out the respective methods described herein. In some embodiments, a specific use computer, containing specialized hardware or computer programming for carrying out one or more of the instructions of the computer program, may be utilized. In some embodiments, the computer system may comprise a device such as, but not limited to a digital phone, cellular phone, laptop computer, desktop computer, digital assistant, server or server/client system.

Computer program, software program, program, software or program code in the present context mean any expression, in any language, code or notation, of a set of instructions readable by a processor or computer system, intended to cause a system having an information processing capability to perform a particular function or bring about a certain result either directly or after either or both of the following: (a) conversion to another language, code or notation; and (b) reproduction in a different material form. A computer program can be written in any form of programming language, including compiled or interpreted languages, and it can be deployed in any form, including as a stand-alone program or as a module, component, subroutine, or other unit suitable for use in a computing environment.

Figure 5:
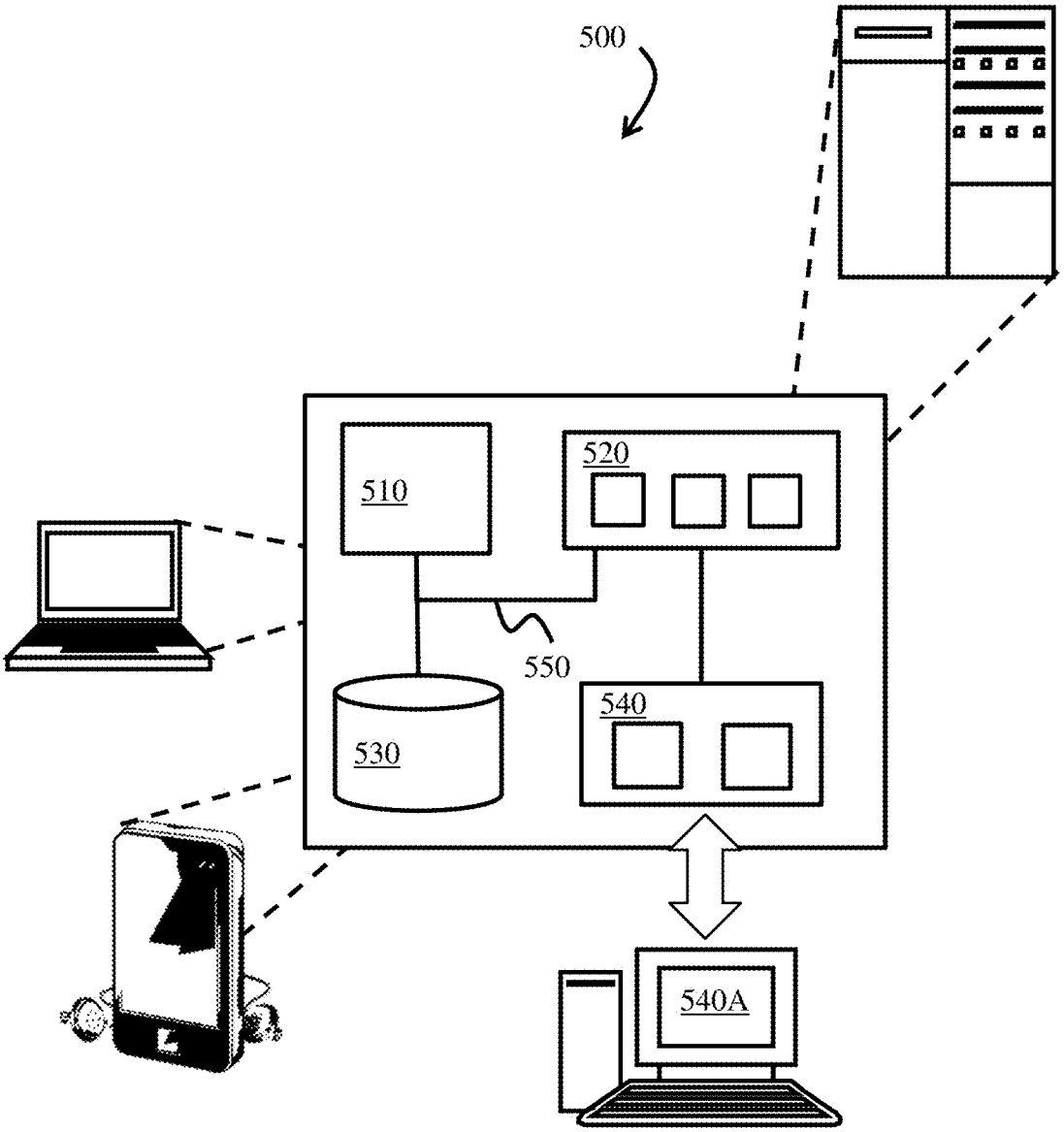
FIG. 5 illustrates one example embodiment of a computer system suitable for use with embodiments of the lottery scratch ticket applications.

FIG. 5 is a schematic diagram of one embodiment of a computer system 500 by which the lottery scratch ticket applications may be carried out. The computer system 500 can be used for the operations described in association with any of the computer implemented methods described herein. The computer system 500 includes at least one processor 510, a memory 520 and an input/output device 540. Each of the components 510, 520, and 540 are operably coupled or interconnected using a system bus 550. The computer system 500 may further comprise a storage device 530 operably coupled or interconnected with the system bus 550.

The processor 510 is capable of receiving the instructions and/or data and processing the instructions of a computer program for execution within the computer system 500. In some embodiments, the processor 510 is a single-threaded processor. In some embodiments, the processor 510 is a multi-threaded processor. The processor 510 is capable of processing instructions of a computer stored in the memory 520 or on the storage device 530 to communicate information to the input/output device 540. Suitable processors for the execution of the computer program instruction include, by way of example, both general and special purpose microprocessors, and a sole processor or one of multiple processors of any kind of computer.

The memory 520 stores information within the computer system 500. Memory 520 may comprise a magnetic disk such as an internal hard disk or removable disk; a magneto-optical disk; an optical disk; or a semiconductor memory device such as PROM, EPROM, EEPROM or a flash memory device. In some embodiments, the memory 520 comprises a transitory or non-transitory computer readable medium. In some embodiments, the memory 520 is a volatile memory unit. In another embodiments, the memory 520 is a non-volatile memory unit.

The processor 510 and the memory 520 can be supplemented by, or incorporated in, ASICs (application-specific integrated circuits).

The storage device 530 may be capable of providing mass storage for the system 500. In various embodiments, the storage device 530 may be, for example only and not for limitation, a computer readable medium such as a floppy disk, a hard disk, an optical disk, a tape device, CD-ROM and DVD-ROM disks, alone or with a device to read the computer readable medium, or any other means known to the skilled artisan for providing the computer program to the computer system for execution thereby. In some embodiments, the storage device 530 comprises a transitory or non-transitory computer readable medium.

In some embodiments, the memory 520 and/or the storage device 530 may be located on a remote system such as a server system, coupled to the processor 510 via a network interface, such as an Ethernet interface.

The input/output device 540 provides input/output operations for the system 500 and may be in communication with a user interface 540A as shown. In one embodiment, the input/output device 540 includes a keyboard and/or pointing device. In some embodiments, the input/output device 540 includes a display unit for displaying graphical user interfaces or the input/output device 540 may comprise a touch-screen. In some embodiments, the user interface 540A comprises devices such as, but not limited to a keyboard, pointing device, display device or a touchscreen that provides a user with the ability to communicate with the input/output device 540.

The computer system 500 can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, wireless phone networks and the computers and networks forming the Internet.

One example embodiment of the lottery scratch ticket applications may be embodied in a computer program product, the computer program product comprising a computer readable medium having a computer readable program code tangibly embodied therewith, the computer program code configured to implement the methods described herein, and which, when loaded in a computer system comprising a processor, is able to carry out these methods.

Although this invention has been described in the above forms with a certain degree of particularity, it is understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention which is defined in the claims and their equivalents.

We claim:

1. A processor-based method of recommending a lottery ticket to a user for playing a lottery game, the method comprising:

receiving a game structure for each of a plurality of lottery games;

receiving an updated data for one or more of the plurality of lottery games;

determining a current odds of a dynamic odds for the plurality of lottery games from the updated data wherein the current odds at a first time are different than the current odds at a second time;

receiving a user profile;

the user profile comprising a direct user input;

determining a recommended lottery ticket from the plurality of lottery games for the user to play based on the game structure, the updated data, the user profile and the current odds for the plurality of lottery games;

wherein the recommended lottery ticket is a scratch ticket and the plurality of lottery games comprises a plurality of scratch ticket games; and communicating the recommended lottery ticket to a user interface.

2. The processor-based method of claim 1 wherein:

the game structure comprises:

one or more prizes, a number of lottery tickets, and an odds of winning the one or more prizes based on the one or more prizes and the number of lottery tickets, and the updated data comprises:

a number of the one or more prizes remaining, and a number of tickets remaining; and the step of determining the current odds for the plurality of lottery games from the updated data comprises determining the current odds for the plurality of lottery games based on the number of the one or more prizes remaining and the number of tickets remaining.

3. The processor-based method of claim 2 wherein:

the game structure comprises a plurality of prize levels for each of the lottery tickets;

the updated data further comprising:

an updated odds of winning the one or more prizes at each of the plurality of prize levels, and a number of the one or more prizes remaining at each of the plurality of prize levels; and the number of tickets remaining is determined by:

estimating a lower bound of a number of lottery tickets remaining at each of the plurality of prize levels and an upper bound of the number of lottery tickets remaining at each of the plurality of prize levels wherein:

the lower bound of the number of lottery tickets remaining comprises an estimate of a largest minimum number of lottery tickets at each of the plurality of prize levels, and the upper bound of the number of lottery tickets remaining comprises an estimate of a smallest maximum number of lottery tickets at each of the plurality of prize levels; and determining an average of the lower bound of the number of lottery tickets remaining and the upper bound of the number of lottery tickets remaining as the number of lottery tickets remaining in the plurality of lottery games.

4. The processor-based method of claim 3 further comprising:

determining an economic metric of the one or more lottery games;

determining a quantitative metric of an appeal of each lottery ticket of the one or more lottery games to the user based on the user profile;

determining a ranking of the appeal of each lottery ticket of the one or more lottery games to the user based on the quantitative metric; and wherein the user profile is adjusted over time based on:

a direct user input to the user interface, a survey data, an interaction with the user interface, a demographic data, and an interest of the user as indicated by a publicly available social media presence of the user.

5. The processor-based method of claim 1 wherein the step of determining the recommended lottery ticket from the plurality of lottery games for the user to play based on the game structure, the updated data, the user profile and the current odds for the plurality of lottery games comprises determining the recommended lottery ticket from the plurality of lottery games for the user to play based on the game structure, the updated data, the user profile, the current odds for the plurality of lottery games, a cost of the lottery ticket and an amount of time each of the plurality of games have been sold.

6. The processor-based method of claim 1 wherein:

the recommended lottery ticket comprises a combination of a plurality of scratch tickets; and step of determining the recommended lottery ticket from the plurality of lottery games for the user to play based on the game structure, the updated data, the user profile and the current odds for the plurality of lottery games comprises determining the combination of the plurality of scratch tickets from the plurality of lottery games for the user to play based on the game structure, the updated data, the user profile, the current odds for the plurality of lottery games, a cost of the lottery ticket, an amount of time each of the plurality of games have been sold, and a budget of the user.

7. The processor-based method of claim 1 further comprising determining a quantitative metric of an appeal of the lottery ticket of the one or more lottery games to the user.

8. The processor-based method of claim 1 further comprising:

determining a quantitative metric of an appeal of each lottery ticket of the one or more lottery games to a user based on the user profile;

determining a ranking of the appeal of each lottery ticket of the one or more lottery games to the user based on the quantitative metric; and the step of determining a recommended lottery ticket from the plurality of lottery games for the user to play based on the game structure, the updated data, the user profile and the current odds for the plurality of lottery games comprises determining a recommended lottery ticket from the plurality of lottery games for the user to play based on the game structure, the updated data, the user profile, the current odds for the plurality of lottery games and the ranking of the appeal of each lottery ticket to the user.

9. The processor-based method of claim 8 further comprising:

determining an economic metric of the one more lottery games wherein the economic metric comprises an extrapolated economic metric of the one more lottery games; and determining the ranking of the appeal of each lottery ticket of the one more lottery games to the user based on the quantitative metric and the extrapolated economic metric.

10. The processor-based method of claim 9 wherein:

the economic metric further comprises a historical economic metric of the one or more lottery games; and determining the ranking of the appeal of each lottery ticket of the one more lottery games to the user based on the quantitative metric and the extrapolated economic metric comprises determining the ranking of the appeal of each lottery ticket of the one more lottery games to the user based on the quantitative metric, the extrapolated economic metric and the historical economic metric.

11. The processor-based method of claim 1 further comprising ranking an appeal of the lottery ticket of the one or more lottery games to a user based on the current odds for each of the plurality of lottery games.

12. The processor-based method of claim 1 wherein the user profile is adjusted over time based on:

a direct user input to the user interface;

a survey data;

an interaction with the user interface;

a demographic data; and an interest of the user as indicated by a publicly available social media presence of the user.

13. The processor-based method of claim 1 wherein the user profile further comprises a user input preference to buy the lottery ticket that provides one or more of:

a highest expected value;

a highest expected value with break-even prizes removed;

a highest odds for winning any prize;

a highest odds for winning any prize with the break-even prizes removed; and a highest odds for winning a prize equal or greater to a specified dollar amount.

14. The processor-based method of claim 1 further comprising:

determining an extrapolated sales trend from the updated data; and wherein the step of determining a recommended lottery ticket from the plurality of lottery games for the user to play based on the game structure, the updated data and the user profile further comprises determining the recommended lottery ticket from the plurality of lottery games for the user to play based on the game structure, the updated data, the user profile and the extrapolated sales trend.

15. The processor-based method of claim 14 wherein determining the extrapolated sales trend from the updated data comprises determining the extrapolated sales trend from at least one of data from the group consisting of:

a remaining prize data;

a game start date;

a game end date;

a mention in a traditional media;

a mention in a social media;

a direct feedback solicited from a lottery ticket user; and a user interaction measurement with the user interface.

16. A lottery scratch ticket application system for recommending a lottery ticket to a user for playing a lottery game, the system comprising:

one or more processors; and one or more memory elements including instructions that, when executed, cause the one or more processors to perform operations comprising:

receiving a game structure for each of a plurality of lottery games;

receiving an updated data for one or more of the plurality of lottery games;

determining a current odds of a dynamic odds for the plurality of lottery games from the updated data wherein the current odds at a first time are different than the current odds at a second time;

receiving a user profile;

the user profile comprising a direct user input;

determining a recommended lottery ticket from the plurality of lottery games for the user to play based on the game structure, the updated data, the user profile, and the current odds for the plurality of lottery games;

wherein the recommended lottery ticket is a scratch ticket and the plurality of lottery games comprises a plurality of scratch ticket games; and communicating the recommended lottery ticket to a user interface.

17. A lottery scratch ticket application system recommending a lottery ticket to a user for playing a lottery game, the lottery scratch ticket application system comprising:

a non-transitory computer readable medium having a computer readable program code embodied therein, said computer readable program code configured to be executed to implement a method comprising:

receiving a game structure for each of a plurality of lottery games;

receiving an updated data for one or more of the plurality of lottery games;

determining a current odds of a dynamic odds for the plurality of lottery games from the updated data wherein the current odds at a first time are different than the current odds at a second time;

receiving a user profile;

the user profile comprising a direct user input;

determining a recommended lottery ticket for the user to play based on the game structure, the updated data, the user profile, and the current odds for the plurality of lottery games;

wherein the recommended lottery ticket is a scratch ticket and the plurality of lottery games comprises a plurality of scratch ticket games; and communicating the recommended lottery ticket to a user interface.

* * * * *